US006719131B1

(12) United States Patent
Focke et al.

(10) Patent No.: US 6,719,131 B1
(45) Date of Patent: Apr. 13, 2004

(54) HINGED-LID PACKAGE FOR CIGARETTES

(75) Inventors: Heinz Focke, Verden (DE); Viktor Hein, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 87 days.

(21) Appl. No.: 10/048,907

(22) PCT Filed: Jul. 12, 2000

(86) PCT No.: PCT/EP00/06600

§ 371 (c)(1),
(2), (4) Date: Feb. 4, 2002

(87) PCT Pub. No.: WO01/12527

PCT Pub. Date: Feb. 22, 2001

(30) Foreign Application Priority Data

Aug. 16, 1999 (DE) ..... 199 38 167

(51) Int. Cl.[7] ..... B65D 85/10; B65D 43/16

(52) U.S. Cl. ..... 206/268; 206/273; 229/148; 229/160.1

(58) Field of Search ..... 206/266, 268, 206/270, 271, 273; 229/146, 148, 149, 160.1

(56) References Cited

U.S. PATENT DOCUMENTS 3,326,447 A * 6/1967 Williamson ..... 229/149
4,428,525 A * 1/1984 Brauner ..... 229/148
4,948,038 A 8/1990 Moeller
5,443,202 A * 8/1995 Jorgensen-Beck et al. ..... 229/160.1
6,105,856 A * 8/2000 Kakiuchi ..... 206/268
6,334,532 B1 * 1/2002 Tambo et al. ..... 206/268

FOREIGN PATENT DOCUMENTS

| | | |
|---|---|---|
| DE | 2334190 | 1/1975 |
| DE | 4122900 A1 | 1/1993 |
| DE | 19614043 A1 | 10/1997 |
| DE | 19644759 A1 | 4/1998 |
| EP | 0894737 A1 | 2/1999 |

* cited by examiner

*Primary Examiner*—Luan K. Bui
(74) *Attorney, Agent, or Firm*—Technoprop Colton LLP

(57) ABSTRACT

Hinge-lid box for cigarettes or other packaged items, comprising a box part (10), lid (11) and collar (12) with a closure aid for the lid (11). Inwardly directed protrusions, namely anchoring tabs (37), are arranged on the inside of a lid front wall (21) or of a lid inner flap (28) and, in the closed position, interact, by form-fitting engagement, with recesses in the region of a collar front wall (32). The depressions in the region of the collar front wall (32) are positioned immediately above a mating closure edge (30) formed by a box front wall (14), with the anchoring tabs (37) arranged appropriately on the lid inner flap (28).

5 Claims, 4 Drawing Sheets

21
29
37
14
22
27
20
23
30
16
15
11
10

27
29
30
33
20
15
12
22
21
14
27
33
46
20

Fig.6
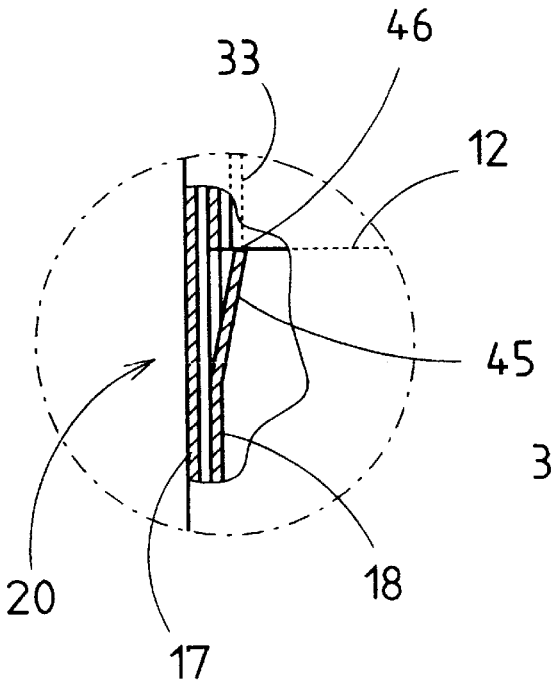
Fig.7
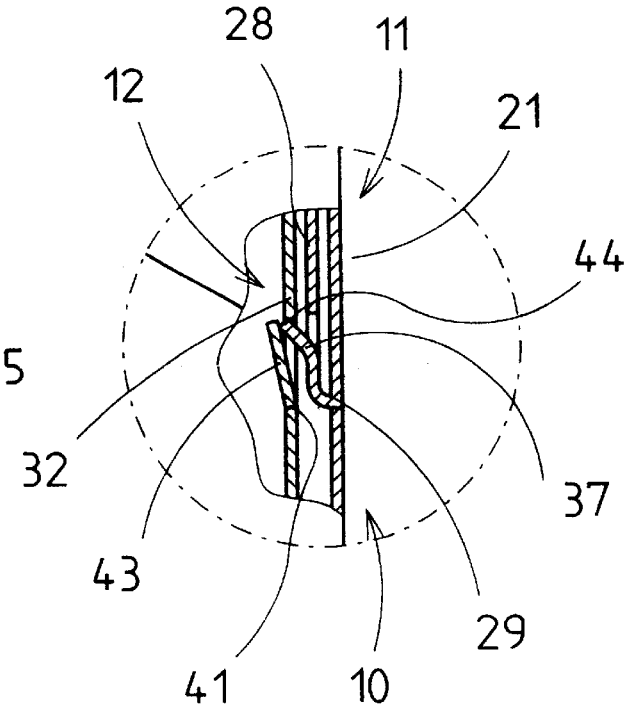
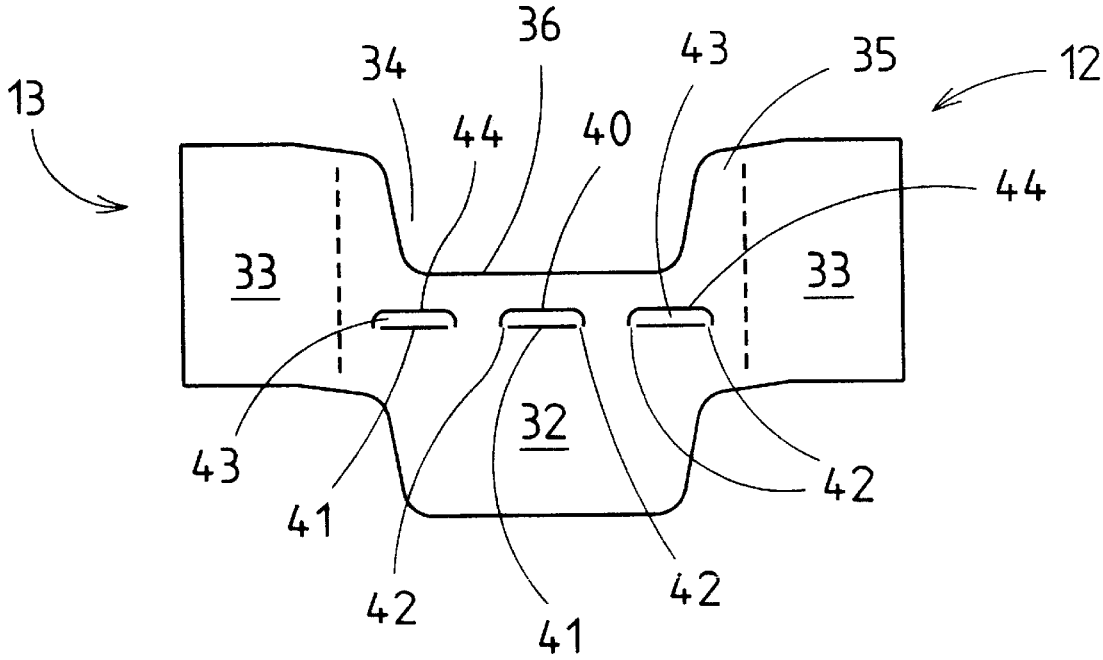
Fig.8

HINGED-LID PACKAGE FOR CIGARETTES

BACKGROUND OF THE INVENTION

1. Technical Field

The invention relates to a hinge-lid box for cigarettes or the like, comprising a box part, a lid, which is connected pivotably thereto, and a collar which is anchored in the box part and projects out of the box part by way of a top collar part, the lid enclosing the top collar part in the closed position, and tabs formed by U-shaped punched sections in the region of a lid inner flap arranged on the inside of a lid fron wall engaging with tabs which are likewise formed by punched sections in the region of a collar front wall (32).

2. Prior Art

A hinge-lid box with a closure aid designed in the above manner is known from EP 0 894 737 A1. In this known pack, a recess or tab formed by a U-shaped punched section is defined in the region of the lid, namely in the lid inner flap. A free edge of the tab or of the depression formed, said edge being directed toward the closure edge of the lid, serves as an intelocking means when the lid is closed. The mating element is formed in the region of the collar front wall and comprises a tab which is formed by a U-shaped punched section and of which the articulation line is directed toward a free, top edge of the collar. In the functional position, the tab is directed obliquely downward at an acute angle. In the closed position of the lid, the lid inner flap grips behind the tab in the lid front wall by way of a crosspiece bounded by the punched section. Accordingly, interlocking of two angled tabs or crosspieces takes place here. As a result, rather than being precisely defined, the interlocking position can be changed on account of the displaceability of the interlocking elements in relation to one another.

BRIEF SUMMARY OF THE INVENTION

The object of the invention is to provide a hinge-lid box with closure aid of the type mentioned in the introduction which ensures a precise closed position such that the closure edges formed by the lid, on the one hand, and the box part, on the other hand, butt precisely against one another.

In order to achieve this object, the hinge-lid box according to the invention is characterized by the following features:

a) the anchoring tab (37), which is formed in the region of the lid inner flap (28) by a U-shaped or C-shaped punched section (38), has an articulation line (39) which is directed toward a closure edge (29), which is formed by the lid front wall (21) and lid inner flap (28), such that, when the lid (11) is closed, the anchoring tab (37) is directed upward at an acute angle, b) in order to form a mating element for the anchoring tab (37), tabs (43) are formed in the region of the collar front wall (32) by a U-shaped or C-shaped punched section (40) such that an articulation line of the tab (43) is directed toward a mating closure edge (30) formed by a box front wall (14), c) when the lid (11) is closed, the anchoring tab (37) butts against an interlocking edge (44) of the collar front wall (32), said interlocking edge being formed by the punched section (40) in the region of the collar front wall (32).

The configuration according to the invention of the hinge-lid box and/or of the closure aid results in the lid and collar interlocking such that the anchoring tab of one part, namely of the lid, butts against an interlocking edge of the other part, namely of the collar. The support of the anchoring tab on the interlocking edge of a recess formed in the collar by the punched section provides a precise closed position, which is determined by the position of the interlocking edge.

In order to ensure this precise closed position, according to the invention, in particular three interlocking elements are positioned one beside the other in each case in the region of the lid inner flap, on the one hand, and collar front wall, on the other hand. Furthermore, there is a very precise arrangement of the tabs in the region of the collar front wall, namely such that punch lines for forming articulation lines run directly level with the closure edge formed by the front wall.

Further features of the invention form the subject matter of subclaims.

BRIEF DESCRIPTION OF THE DRAWINGS

Further details and special features of the invention are explained hereinbelow with reference to an exemplary embodiment of a hinge-lid box illustrated in the drawings, in which:

FIG. 6 shows, on an enlarged scale, a detail VI from FIG. 4 in vertical section, FIG. 7 shows a detail VII from FIG. 5 in an illustration corresponding to FIG. 6, and FIG. 8 shows a collar for the hinge-lid box as a spread-out blank.

DETAILED DESCRIPTION OF THE PREFERRED EMBODIMENTS

That exemplary embodiment of a hinge-lid box which is illustrated here is intended, and suitable, in particular for accommodating a group of cigarettes. The cigarettes are usually enclosed by an inner wrapper made of paper or tin foil to form a cigarette block (not shown). The latter fits in the hinge-lid box.

Figures 4, 5:
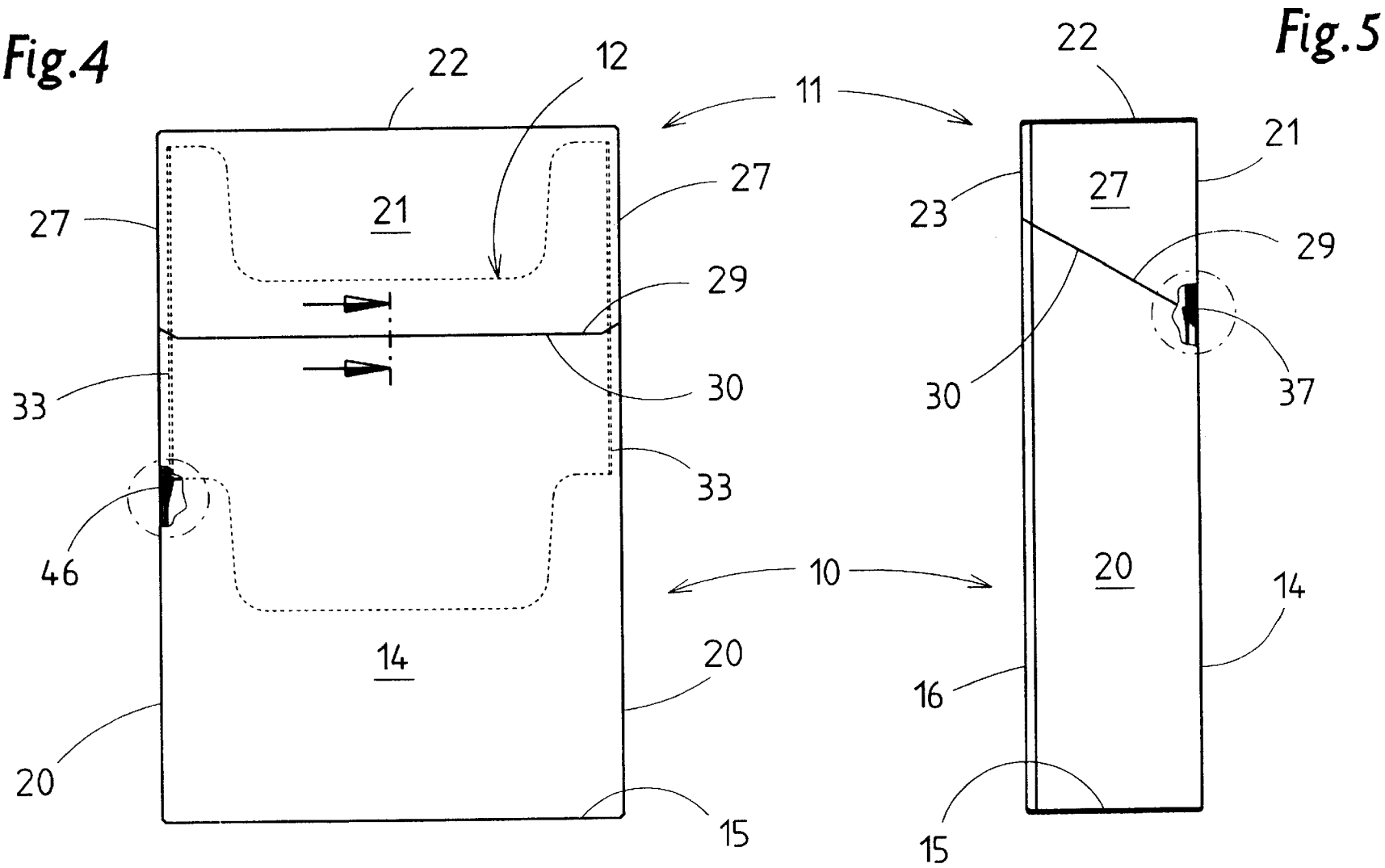
FIG. 4 shows the hinge-lid box according to FIG. 1 in the closed position, to be precise in a front view.
FIG. 5 shows a side view of the hinge-lid box according to FIG. 4.

The hinge-lid box comprises a box part 10 and lid 11. Arranged within the box part 10 is a collar 12 which is anchored in the box part 10 by way of a bottom sub-region and projects out of the box part 10 by way of a top collar part 13. The top collar part 13 is enclosed by the lid 11 in the closed position of the latter (FIG. 4).

Figure 2:
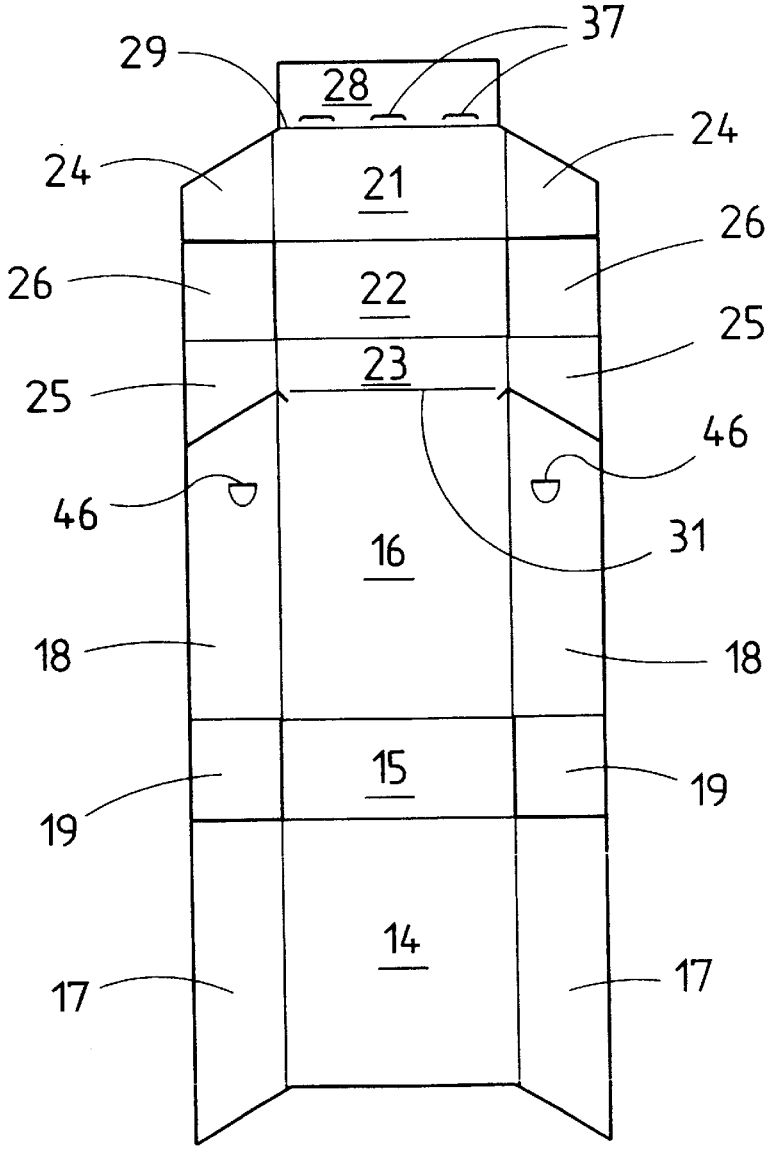
FIG. 2 shows a spread-out blank for producing a hinge-lid box according to FIG. 1.

The hinge-lid box comprises a blank, of which a standard exemplary embodiment is shown in FIG. 2. Punch lines and longitudinal and transverse folding lines define surface regions of the blank, which result in the formation of the box part 10, on the one hand, and of the lid 11, on the other hand. The box part 10 comprises a box front wall 14, adjoining base wall 15 and box rear wall 16. (Outer) box side flaps 17 are provided laterally on the box front wall 14 and correspondingly designed (inner) box side flaps 18 are provided laterally on the box rear wall 16. Connected to the latter box side flaps in each case are base corner flaps 19 which, when the hinge-lid box is completed, rest on the inside of the base wall 15. The two box side flaps 17 and 18 assigned to one another overlap one another when the hinge-lid box is completed, in order to form a lateral, upright box side wall 20 in each case.

The lid 11 is of analogous design, namely with a lid front wall 12, a top end wall 22 and a lid rear wall 23. (Outer) lid side flap 24 and (inner) lid side flap (25) serve for forming a double-layered lid side wall 27. Lid corner flaps 26 are connected to the inner lid side flaps 25. A lid inner flap 28 is connected to the free border or the free side of the lid front wall 21. When the hinge-lid box is completed, said lid inner flap is folded over against the inside of the lid front wall 21 and connected thereto by adhesive bonding or the like.

A free border of the lid front wall 21, namely a folding edge formed by the lid inner flap 28, forms a top, lid-side closure edge 29 of the hinge-lid box. Corresponding with said closure edge is a mating closure edge 30, which is formed by a free top edge of the box front wall 14. When the lid 11 is closed, the closure edge 29 should butt against the mating closure edge 30.

The lid 11 is connected to the box rear wall 16 such that it can be pivoted about a transversely directed hinge line 31 in the region of the lid rear wall 23. The collar 12 comprises a collar front wall 32 and collar side flaps 33. The collar front wall 32 is provided with a recess 34 in the top region, that is to say in the region of the top collar part 13. Said recess is bounded by lateral, upright ridges 35 and a bottom transverse web 36 above the mating closure edge 30 of the box front wall 14. The collar front wall 32 is expediently connected to the inside of the box front wall 14. The collar side flaps 33 butt against the inside of the box side walls 20, namely against the inner box side flaps 18.

A special feature of the present hinge-lid box is the configuration and positioning of a closure aid. This is formed by the lid front wall 21, on the one hand, and the collar front wall 32, on the other hand. Correspondingly designed interlocking elements are provided on the inside of the lid front wall 21 or of the lid inner flap 28, on the one hand, and on the outside of the collar front wall 32, on the other hand, these engaging with one another with a form fit and/or force fit in the actual closed position of the lid 11, namely with the closure edge 29 butting against the mating closure edge 30.

Figure 1:
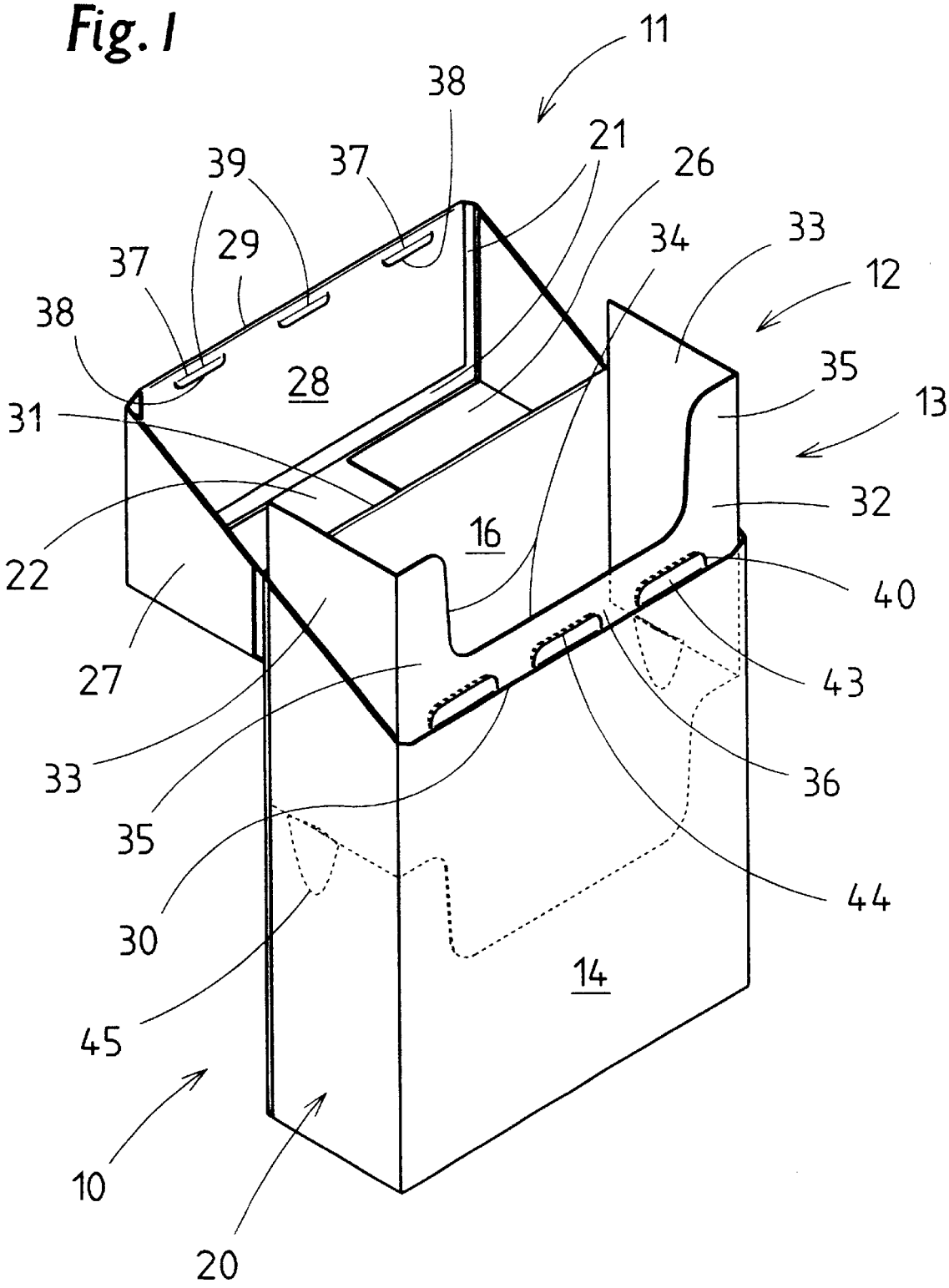
FIG. 1 shows a perspective illustration of an empty hinge-lid box with the lid in the open position.
Figure 3:
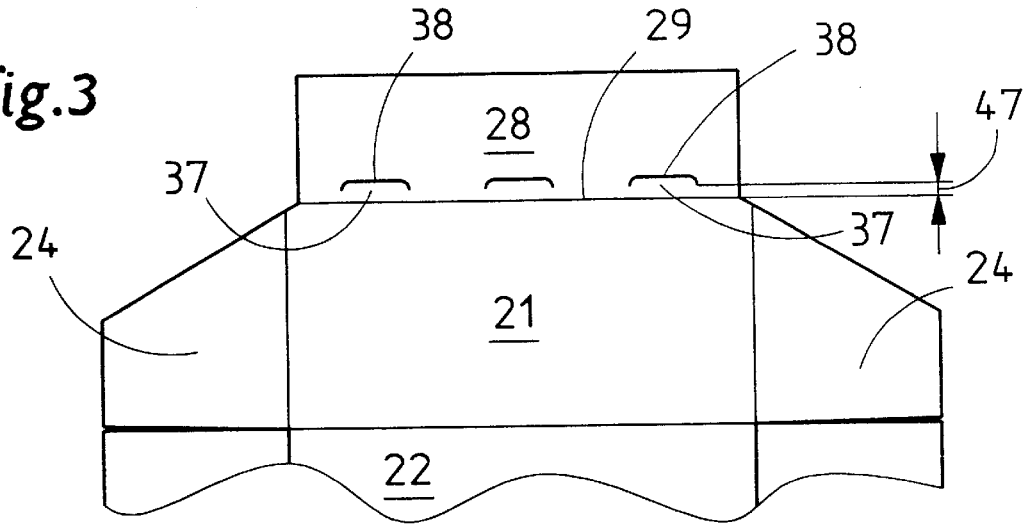
FIG. 3 shows, on an enlarged scale, part of the blank according to FIG. 2 in the region of the lid.

In the present, preferred exemplary embodiment, the lid inner flap 28 is provided with protrusions, namely with hook-like anchoring tabs 37, in a region directly adjacent to the closure edge 29. A plurality of anchoring tabs 37, that is to say in the present case three anchoring tabs 37, are spaced apart one beside the other in a line. The anchoring tab is formed by a U-shaped or C-shaped punched section 38 in the lid inner flap 28. The shape of the punched section 38 produces the tongue-like anchoring tab 37 with an articulation line 39 between the free ends. The punched section 38 is arranged such that the anchoring tab 37, which projects by being bent away from the lid inner flap 28, forms a hook-like element directed away from the closure edge 29. The punched sections 38, and the resulting anchoring tabs 37, are spaced apart from the closure edge 29 by a small distance 47. As can be seen from FIG. 3, the distance of the end legs of the punched section 38, and thus of the articulation line 39 formed, from the closure edge 29 is approximately 0.5 mm to 3 mm, in particular 1.5 mm to 2 mm.

The anchoring tabs 37 interact with mating elements in the region of the collar front wall 32, to be precise directly adjacent to the mating closure edge 30. There, recesses or depressions are formed in a number corresponding to the anchoring tabs 37, said recesses or depressions likewise being formed by U-shaped or C-shaped punched sections 40. Transversely directed punch lines 41 are provided beneath said punched sections 40. These punch lines terminate at a distance from the ends of the punched sections 40, with the result that small residual connections 42 remain. Tabs 43 may thus be pivoted back inward to form a recess with an interlocking edge 44 formed by the punched section 40.

When the hinge-lid box is closed, the abovedescribed interlocking elements engage one inside the other with a form fit (FIG. 7). The inwardly projecting anchoring tabs 37 force back the tabs 43 and pass into the recesses released by said tabs 43, and are fixed on the interlocking edges 44. When the lid 11 is opened, the anchoring tabs 47 are deformed such that the lid 11 can easily be pivoted into the open position.

It is also possible for fully free openings to be formed in the region of the collar front wall 32 in order to accommodate the anchoring tabs 37.

In order for the closure aid to be effective, it is important for the collar 12 to be positioned precisely in the box part 10. In the present exemplary embodiment, the collar 12 is supported in the box part 10 on adjusting protrusions. In the exemplary embodiment shown, protrusions 45 are formed on the inner box side flaps on both sides. Said protrusions comprise a transverse punched section 46 and an inwardly directed embossing or curvature of the material. The transverse punched section 46 thus forms a supporting edge for the collar side flaps 33 (FIG. 6). The precise arrangement of these protrusions 45 also results in the collar always being positioned precisely in the box part, and thus also the anchoring elements thereof.

The punched sections 40 in the region of the collar front wall 32 are positioned such that the "bottom" punch lines 41 are located in the region of the mating closure edge 30, in particular in the same plane.

The abovedescribed closure aid is particularly advantageous and important for hinge-lid boxes configured with round edges, that is to say rounded upright pack edges, or with oblique edges, that is to say octagonal packs.

LIST OF DESIGNATIONS

10 Box part
11 Lid
12 Collar
13 Top collar part
14 Box front wall
15 Base wall
16 Box rear wall
17 Box side flap section
18 Box side flap
19 Base corner flap
20 Box side wall
21 Lid front wall
22 End wall
23 Lid rear wall
24 Lid side flap
25 Lid side flap
26 Lid corner flap
27 Lid side wall
28 Lid inner flap
29 Closure edge
30 Mating closure edge
31 Hinge line
32 Collar front wall
33 Collar side flap

34 Recess
35 Ridge
36 Transverse web
37 Anchoring tab
38 Punched section
39 Articulation line
40 Punched section
41 Punch line
42 Residual connection
43 Tab
44 Interlocking edge
45 Protrusion
46 Transverse punched section
47 Distance

What is claimed is:

1. A hinge-lid box for cigarettes or the like, comprising a box part (10), a lid (11), which is connected pivotably thereto, and a collar (12), which is anchored in the box part (10) and projects out of the box part (10) by way of a top collar part (13), the lid (11) enclosing the top collar part (13) in the closed position, and tabs formed by U-shaped punched sections in the region of a lid inner flap (28) arranged on the inside of a lid front wall (21) engaging with tabs which are likewise formed by punched sections in the region of a collar front wall (32), characterized by the following features:

a) the anchoring tab (37), which is formed in the region of the lid inner flap (28) by a U-shaped or C-shaped punched section (38), has an articulation line (39) which is directed toward a closure edge (29), which is formed by the lid front wall (21) and lid inner flap (28), such that, when the lid (11) is closed, the anchoring tab (37) is directed upward at an acute angle, b) in order to form a mating element for the anchoring tab (37), tabs (43) are formed in the region of the collar front wall (32) by a U-shaped or C-shaped punched section (40) such that an articulation line of the tab (43) is directed toward a mating closure edge (30) formed by a box front wall (14), c) when the lid (11) is closed, the anchoring tab (37) butts against an interlocking edge (44) of the collar front wall (32), said interlocking edge being formed by the punched section (40) in the region of the collar front wall (32).

2. The hinge-lid box as claimed in claim 1, characterized in that the articulation line (39) of the anchoring tab (37), in the region of the lid inner flap (28), runs directly adjacent to the closure edge (29), which is formed by the lid inner flap (28) being folded over, in particular at a distance therefrom of approximately 1.5 mm to 2 mm.

3. The hinge-lid box as claimed in claim 1, characterized in that the punched section (40) for bounding the tab (43) is arranged in the region of the collar front wall (32) such that an articulation line of the tab (43), namely a punch line (41) with residual connections (42), is located in the region of the mating closure edge (30), which is formed by the box front wall (14).

4. The hinge-lid box as claimed in claim 1, characterized in that the lid inner flap (28) has a plurality of, in particular three, anchoring tabs (37) which are located one beside the other, are formed by punched sections (38), are oriented in an oblique position or at an acute angle in relation to the plane of the lid inner flap (28) and, in the closed position of the lid (11), pass into corresponding recesses in the region of the top collar part (13).

5. The hinge-lid box as claimed in claim 1, characterized in that protrusions (45) support the collar (12) in respect of the precise relative position within the box part (10).

* * * * *